US006455999B1

(12) United States Patent
Hasegawa et al.

(10) Patent No.: US 6,455,999 B1
(45) Date of Patent: Sep. 24, 2002

(54) COLOR PICTURE TUBE

(75) Inventors: Takahiro Hasegawa, Gyoda; Syunji Ookubo, Kumagaya; Shigeru Sugawara, Saitama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/485,691

(22) PCT Filed: Jun. 25, 1999

(86) PCT No.: PCT/JP99/03429

§ 371 (c)(1),
(2), (4) Date: Apr. 4, 2000

(87) PCT Pub. No.: WO99/67805

PCT Pub. Date: Dec. 29, 1999

(30) Foreign Application Priority Data

Jun. 25, 1998 (JP) ..... 10-178686

(51) Int. Cl.[7] ..... H01J 29/02

(52) U.S. Cl. ..... 313/477 HC; 313/482; 313/440; 439/150; 439/618

(58) Field of Search ..... 313/477 HC, 440, 313/477 R, 482; 439/150, 618, 683

(56) References Cited

U.S. PATENT DOCUMENTS 4,126,371 A * 11/1978 Puhak ..... 339/144 T
5,818,155 A * 10/1998 Kawamura et al. .... 313/318.05
5,898,264 A * 4/1999 Nose et al. ..... 313/477 HC
5,990,610 A * 11/1999 Matsumoto et al. .. 313/477 HC
6,043,598 A * 3/2000 Park et al. ..... 313/440

FOREIGN PATENT DOCUMENTS

| | | |
|---|---|---|
| JP | 57-126156 | 8/1982 |
| JP | 59-119656 | 7/1984 |
| JP | 4-286829 | 10/1992 |
| JP | 5-251020 | 9/1993 |
| JP | 8-148103 | 6/1996 |
| JP | 9-245688 | 9/1997 |

* cited by examiner

*Primary Examiner*—Nimeshkumar D. Patel
*Assistant Examiner*—Thelma Sheree Clove
(74) *Attorney, Agent, or Firm*—Oblon, Spivak, McClelland, Maier & Neustadt, P.C.

(57) ABSTRACT

In a color cathode ray tube, the outer diameter of a neck is set at 22 mm–23 mm, the diameter of a pin circle formed by stem pins outside the flare section of a stem welded to an end of the neck is set at a nominal value of 15.24 mm, and the maximum diameter of a base adhered to an outer surface of the stem is set at 23 mm or less. Accordingly, while the neck outer diameter is reduced to reduce the power consumption of the color cathode ray tube, the color cathode ray tube has a high resolution.

10 Claims, 5 Drawing Sheets

COLOR PICTURE TUBE

TECHNICAL FILED

This invention relates to a color cathode ray tube, and more particular to a color cathode ray tube equipped with an improved base which is attached to a neck section, wherein power saving and high resolution with reduced power consumption can be realized.

BACKGROUND ART

In general, in color cathode ray tubes, a panel and a funnel constitute an envelope, and an electron gun assembly is provided in the funnel's cylindrical neck. Three electron beams emitted from the electron gun assembly are deflected by a magnetic field generated from a deflecting yoke that is mounted on the outer surface of the funnel, and are directed, via a shadow mask, to a phosphor screen provided on the inner surface of the panel. The phosphor screen is thus horizontally and vertically scanned by the three electron beams, thereby displaying a color image thereon.

At present, the color cathode ray tubes constructed as above are mainly of an inline type, in which three electron beams emitted from the electron gun assembly are arranged in line to pass in a single horizontal plane.

The electron gun assembly generally has three cathodes, three heaters each for heating a corresponding one of the three cathodes, and a plurality of electrodes provided between the cathodes and the phosphor screen. These heaters, cathodes and electrodes are fixed integrally as one body by an insulating support bar.

In the electron gun assembly, an electron beam generating section is formed of the cathodes and first and second electrodes adjacent thereto in this order, while a main lens section for converging, onto the phosphor screen, electron beams emitted from the electron beam generating section is formed of a plurality of electrodes located between the first and second electrodes and the phosphor screen.

In the electron gun assembly constructed as above, a plurality of stem pins are airtightly inserted through a flare section of a stem welded to an end portion of a neck, and the cathodes are supported by predetermined stem pins, thereby housing the electron gun assembly in the neck. Further, in order to apply necessary voltages for forming the electron beam generating section and the main lens section, the stem pins are connected to the heaters, the cathodes, and the electrodes other than a final accelerating electrode that cooperates with a focusing electrode to form a main lens for finally converging electron beams onto the phosphor screen. A relatively high voltage that is 20–40% of an anode high voltage applied to the final accelerating electrode is generally applied, via the stem pins, to the focusing electrode, which cooperates with the final accelerating electrode to form the main lens. A voltage lower than the voltage applied to the focusing electrode is applied to the heaters, the cathodes and the electrodes other than the focusing electrode and the final accelerating electrode.

In general, the performance of the electron gun assembly is expressed by lens constants such as lens magnification power, spherical aberration, etc. These two constants, in particular, substantially determine the performance of the main lens. The lower the lens constants, the higher the performance of the main lens section, the greater degree the electron beam is converged, and the smaller the beam spot on the screen, which means the higher the resolution.

However, the resolution of color cathode ray tubes is influenced by a magnetic field generated by their deflecting yokes, as well as the performance of the main lens sections of their electron gun assemblies. In the case of inline-type color cathode ray tubes as described above, self-conversion inline type color cathode ray tubes are widely put to practical use, in which three electron beams arranged in line to pass in a single horizontal plane are converged on any point of the entire screen, with a horizontally deflected magnetic field and a vertically deflected magnetic field generated by the deflecting yoke in the shape of a pin cushion and a barrel, respectively. In these color cathode ray tubes, a non-uniform magnetic field, which consists of the pin-cushion shaped horizontally deflected magnetic field and the barrel-shaped vertically deflected magnetic field, will distort the beam spot in a manner such that at a peripheral portion of the screen, the beam spot has a horizontally long core portion of a high luminance and a halo portion of a low luminance extending vertically relative to the core portion. Thus, the resolution is degraded.

As means for eliminating distortion in beam spot due to the non-uniform magnetic field, there is provided a dynamic focusing electron gun assembly, in which a voltage that increases in synchronism with the deflection of electron beams is applied to some of the electrodes in the electron gun assembly, thereby forming a non-symmetrical lens whose power varies in accordance with the deflection of the electron beams to eliminate distortion in beam spot.

In this electron gun assembly, however, it is necessary to add at least one electrode to the electrodes employed in a usual electron gun assembly, and also to add at least one stem pin to those required for the usual electron gun assembly.

On the other hand, to save power required for the color cathode ray tubes, it is desired to reduce the power consumption of their deflecting yokes that consume the greatest power. To this end, it is effective to make a deflection coil approach the electron beams for enhancing its sensitivity for deflection, and hence effective to reduce the outer diameter of the neck on which the deflecting yoke is mounted, so that Lorentz'force caused by the deflected magnetic field of the yoke can be efficiently applied to the electron beams.

At present, the color cathode ray tubes have several standards of nominal neck outer-diameters ranging from 22.5 mm to 36.5 mm, and 29.1 mm is mainly employed. To save the power consumption of the color cathode ray tubes, it is effective to set the neck outer-diameter at 22.5 mm. However, in the case of the stem sealed by a neck with an outer diameter of 22.5 mm, the flare section welded to the neck has a small diameter, and the number of stem pins, which are airtightly inserted circumferentially through the flare section, is 8 that is the minimum number required in each color cathode ray tube. It is considered difficult to increase the number of the stem pins in light of the withstand voltage between them.

In other words, it is very difficult to enhance the resolution of the color cathode ray tube and at the same time to reduce its power consumption.

As means for simultaneously realizing high resolution and power saving, a structure is proposed, in which stem pins are bent within the flare section of a stem designed for a neck with an outer diameter of 22.5 mm, thereby enabling the formation of a pin circle, using outer pins (i.e. outer portions of the stem pins) extending outside the flare section, to have a diameter of 15.24 mm that is equal to the diameter employed in a stem designed for a neck with a diameter of 29.1 mm. By virtue of this structure, the number of the stem pins can be increased.

Concerning the withstand voltage of the stem in the above structure, the outer pins located in the outside atmosphere that contains moisture must be considered. However, there is no problem among the outer pins, since the pitch of the outer pins is same as that of the conventional neck structure with 29.1 mm in the conventional color cathode ray tube. There is almost no problem among inner leads (i.e. inner portions of the stem pins) located in a vacuum atmosphere within the tube. This means that degradation in withstand voltage can be avoided.

Even in the above structure, a base designed for a neck with an outer diameter of 29.1 mm is used as a base to be adhered to the outer surface of the stem for protecting the stem pins, in light of the combination of a socket incorporated in a display unit such as an image receptor, i.e. to secure compatibility with a usual color cathode ray tube. However, in the case of employing the base designed for a neck with an outer diameter of 29.1 mm, the maximum outer diameter RB max around the tube axis is 25.0 mm (radius: 12.5 mm) as shown in FIG. 1. To attach this base, the deflecting yoke to be mounted on the outer surface of the funnel from the neck end side must have a minimum coil diameter of 25.0 mm or more, which means that a gap will be defined between the coil and the neck with the outer diameter of 22.5 mm. Accordingly, even if the neck outer diameter is reduced as described above, sufficient power saving cannot be realized.

As aforementioned, there is a dynamic focusing electron gun assembly, in which a voltage that increases in synchronism with the deflection of electron beams is applied to part of the electrodes included in the electron gun assembly, thereby forming a non-symmetrical lens whose power varies to eliminate distortion in beam spot which may be caused by a non-uniform magnetic field generated from the deflecting yoke. However, in this electron gun assembly, it is necessary to add at least one electrode to the electrodes employed in a usual electron gun assembly, and also to add at least one stem pin to those required for the usual electron gun assembly.

On the other hand, to save power required for the color cathode ray tubes, it is effective to reduce the neck outer diameter to make the deflection coil approach electron beams. If, however, the neck outer diameter is set at 22.5 mm that is the minimum value among the presently standardized values, the number of stem pins employed in the stem for the neck with the outer diameter of 22.5 mm is only 8. To increase the number of the stem pins is difficult in light of the withstand voltage between them.

In other words, it is very difficult to enhance the resolution of the color cathode ray tube and at the same time to save its power consumption.

As means for simultaneously realizing high resolution and power saving in the color cathode ray tube, a structure is proposed, in which the neck outer diameter is set at 22.5 mm, and stem pins are bent within a flare section of a stem designed for the neck with the outer diameter of 22.5 mm, thereby enabling the formation of a pin circle, using the outer pins extending outside the flare section, to have a diameter of 15.24 mm that is equal to the diameter employed in a stem designed for a neck with a diameter of 29.1 mm. By virtue of this structure, the number of the stem pins is increased.

In the above structure, a base designed for a neck with an outer diameter of 29.1 mm is used as a base to be adhered to the outer surface of the stem for protecting the stem pins, in order to secure compatibility with a socket that is to be connected to the base of a usual color cathode ray tube. This base, however, has a diameter of 25.0 mm larger than the outer diameter of the neck. Further, to attach this base, the deflecting yoke to be mounted on the outer surface of the funnel from the neck end side must have a minimum coil diameter of 25.0 mm or more, which means that a gap will be defined between the coil and the neck. Accordingly, even if the neck outer diameter is reduced, sufficient power saving cannot be realized.

DISCLOSURE OF INVENTION

This invention has been developed to solve the above-described problems, and is aimed at constructing a color cathode ray tube capable of realizing high resolution, with its power consumption reduced by the employment of a small neck outer diameter.

The invention provides (1) A color cathode ray tube comprising:

a vacuum envelope including a substantially cylindrical neck, a funnel having an extended portion extending from the neck, and a panel coupled to the funnel;

an electron gun assembly located in the neck and having cathodes, heaters for heating the cathodes and a plurality of electrodes for focusing electron beams emitted from the cathodes;

a stem including a plurality of stem pins connected to the cathodes, the heaters and predetermined ones of the electrodes, and a flare section welded to an end of the neck, the stem pins being airtightly inserted circumferentially through predetermined portions of an outer surface of the flare section of the stem such that the predetermined portions form a reference circle; and a base adhered to the flare section of the stem and having stem-pin inserting holes through which the stem pins are inserted, wherein the neck has an outer diameter of from 22 mm to 23 mm, the reference circle formed by the stem pins on the outer surface of the flare section is set at a pin circle with a nominal diameter of 15.24 mm, and the base has a diameter not more than a maximum diameter of 23 mm.

(2) In the color cathode ray tube specified in item (1), the electron gun assembly is of a dynamic type in which a voltage that varies in synchronism with the deflection of the electron beams emitted from a deflecting yoke is applied to at least one electrode selected from the plurality of electrodes, the voltage that varies in synchronism with the deflection of the electron beams being applied via at least one of the stem pins.

(3) In the color cathode ray tube specified in item (1), the number of the stem pins is not less than 9.

(4) In the color cathode ray tube specified in item (1), partitions radially extend on a surface of the base opposite to a surface thereof adhered to the stem, and partition those of the stem pins connected to those of the electrodes to which a relatively high voltage is applied, from those of the stem pins connected to those of the electrodes, to which a relatively low voltage is applied.

(5) In the color cathode ray tube specified in item (4), the partitions extend across the pin circle of the stem pins to an outer edge of the base.

(6) In the color cathode ray tube specified in item (4), the radial partitions extend across the pin circle of the stem pins to an outer edge of the base, and include a circumferential partition that partitions, together with the radial partitions, those of the stem pins connected to those of the electrodes to which the relatively high voltage is applied, from those of the stem pins connected to those of the electrodes, to which the relatively low voltage is applied.

(7) In the color cathode ray tube specified in item (6), the circumferential partition has a height lower than the radial partitions that extend across the pin circle of the stem pins to the outer edge of the base.

(8) In the color cathode ray tube specified in item (6), the circumferential partition extends along the outer edge of the base.

(9) In the color cathode ray tube specified in item (4), the partitions extend across the pin circle of the stem pins to an intermediate portion between the pin circle and the outer edge of the base.

(10) In the color cathode ray tube specified in item (4), the partitions have a height greater than a length of the stem pins that extend to an outside of the base.

BEST MODE FOR CARRYING OUT THE INVENTION

A color cathode ray tube according to the embodiment of the invention will be described with reference to the accompanying drawings.

Figure 2:
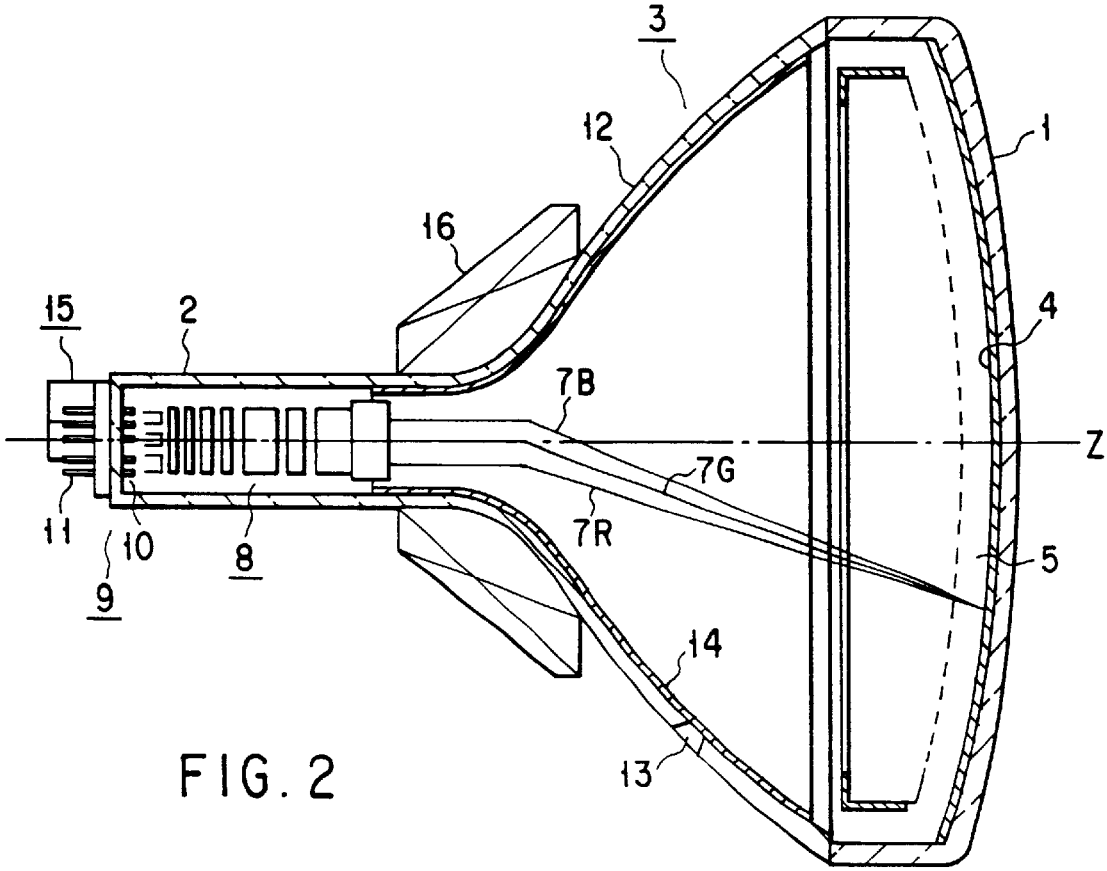
FIG. 2 is a sectional view illustrating the structure of a color cathode ray tube according to the embodiment of the invention.

FIG. 2 schematically shows a self-convergence, inline type color cathode ray tube according to the embodiment of the invention. This color cathode ray tube includes an envelope comprising a panel and a funnel 3 that has an end portion formed of a cylindrical neck 2. A phosphor screen 4 comprising a three-color phosphor layer for emitting blue, green and red light beams is provided on the inner surface of the panel 1, and a shadow mask 5 is fixedly opposed to the phosphor screen 4 inside the panel 1. On the other hand, an electron gun assembly 8 is provided in the neck 2 of the funnel 3 for emitting three electron beams 7B, 7G and 7R arranged in line to pass in a single horizontal plane. The neck 2 has one end thereof airtightly welded to a flare section 10 of a stem 9. The flare section 10 has a plurality of stem pins 11 airtightly inserted circumferentially therethrough. Further, the funnel 3 has a diameter increasing section 12 whose diameter increases toward the panel 1. An anode terminal 13 is provided on the diameter increasing section 12, and an inner surface conductor film 14 extends from the inner surface of the diameter increasing section 12 to the inner surface of an adjacent portion of the neck 2. A base 15 for protecting the stem 9 is adhered to the outside of the stem 9 by an insulating adhesive such as a silicon-based adhesive.

In this color cathode ray tube, the three electron beams 7B, 7G and 7R emitted from the electron gun assembly 8 are deflected horizontally and vertically by a pin-cushion-shaped horizontally deflected magnetic field and a barrel-shaped vertically deflected magnetic field, respectively, and are directed to the phosphor screen 4. The phosphor screen 4 is thus scanned horizontally and vertically by the electron beams, thereby displaying thereon a color image.

Figure 3:
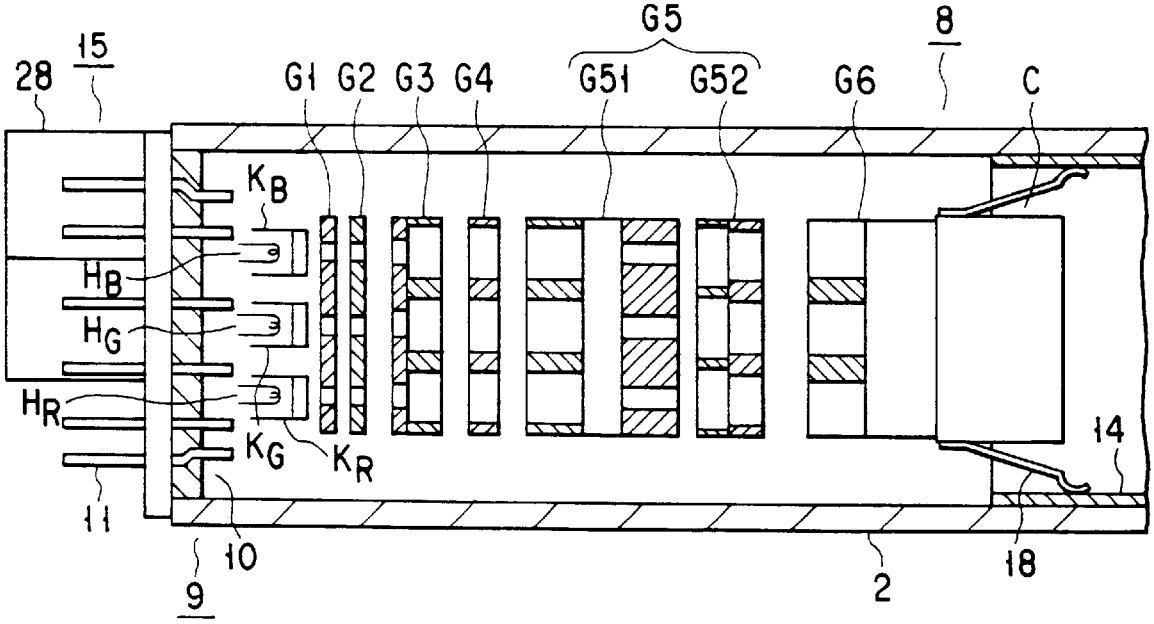
FIG. 3 is a schematic sectional view showing an electron gun assembly incorporated in the color cathode ray tube of FIG. 2, and a neck section which accommodates the electron gun assembly.

As is shown in FIG. 3, the electron gun assembly 8 has three cathodes KB, KG and KR arranged in line, three heaters HB, HG and HR for heating the cathodes KB, KG and KR, respectively, first to fourth electrodes G1–G4 arranged in this order from the cathodes KB, KG and KR side to the phosphor screen side, two segment electrodes G51 and G52 that constitute a fifth electrode G5, a sixth electrode G6, and a shield cup C attached to the sixth electrode G6. The heaters HB, HG and HR, the cathodes KB, KG and KR, and the first to sixth electrodes G1–G6, except for the shield cup C, are fixed integral by a pair of insulating support bars (not shown).

In this electron gun assembly 8, the cathodes KB, KG and KR are supported on the neck 2 by selected predetermined ones of the stem pins 11 provided on the stem 9 that seals the end of the neck 2, the sixth electrode G6 is attached to the shield cup C, and the shield cup C is supported by a bulb spacer 18 urged against the inner surface conductor film 14. By virtue of the stem pins and the bulb spacer 18, the electron gun assembly 8 is located along the axis of the tube.

The three cathodes KB, KG and KR are arranged horizontally in line at intervals of about 5 mm. The first and second electrodes G1 and G2 each have three circular holes for passing the electron beams therethrough, which have a diameter of about 1 mm and are formed in portions thereof corresponding to the cathodes KB, KG and KR. The third electrode G3 has, on the second electrode G2 side, three circular electron-beam-passing holes having a diameter of about 2 mm larger than the holes of the second electrode G2, and formed in line corresponding to the cathodes KB, KG and KR. The third electrode G3 also has, on the fourth electrode G4 side, three circular electron-beam-passing holes having a much larger diameter of about 4–6 mm, and formed in line corresponding to the cathodes KB, KG and KR. Similarly, the fourth electrode G4 and the sixth electrode G6 each have three circular electron-beam-passing holes having a larger diameter of about 4–6 mm, and formed in line corresponding to the cathodes KB, KG and KR.

The segment electrode G51 of the fifth electrode G5 adjacent to the fourth electrode G4 has, at the side of the segment electrode G52, three vertically long electron-beam-passing oval holes having a major axis in the vertical direction and arranged in line corresponding to the cathodes KB, KG and KR. The segment electrode G52 of the fifth electrode G5 adjacent to the sixth electrode G6 has, at the side of the segment electrode G51, three horizontally long electron-beam-passing oval holes having a major axis in the horizontal direction and arranged in line corresponding to the cathodes KB, KG and KR.

The interval between the first and second electrodes G1 and G2 is set at 0.5 mm or less, while the interval between each pair of adjacent ones of the second to sixth electrodes G2–G6 is set at 0.5–1.0 mm.

In the electrode gun assembly 8, a voltage obtained by superimposing a video signal upon a DC voltage of about 150V is applied to each of the cathodes KB, KG and KR, the first electrode G1 is grounded, the second and fourth electrodes G2 and G4 are connected to each other within the tube, and a DC voltage of about 800V is applied to these electrodes G2 and G4. The third electrode G3 is connected to the segment electrode G52 of the fifth electrode G5 within the tube, and a dynamic voltage is applied to these electrodes G3 and G52, which is obtained by superimposing a DC voltage of about 6–9 kV upon a parabola voltage that varies in synchronism with the deflection of the electron beams. A DC voltage similar to the DC component (about 6–9 kV) contained in the voltage applied to the segment electrode G52 of the fifth electrode G5 is applied to the segment electrode G51 of the fifth electrode C5. A high voltage of about 25 kV is applied to the sixth electrode G6.

The high voltage is applied to the sixth electrode G6 via the anode terminal provided at the diameter increasing section of the funnel, the inner surface conductor film 14 provided from the diameter increasing section of the funnel to the inner surface of the adjacent portion of the neck 2, and the bulb spacer 18 urged against the inner surface conductor film 14. On the other hand, the heaters HB, HC and HR, the cathodes KB, KG and KR and the other electrodes G1, G2, G4, G51 and G52 are connected to the stem pins 11 provided through the stem 9 that seals the end of the neck 2, whereby the aforementioned voltages are applied to them via the stem pins 11.

When the voltages are being applied to the electrodes, the cathodes KB, KG and KR and the first and second electrodes G1 and G2 constitute an electron beam generating section. Electron beams emitted from the electron beam generating section form cross-over points in the vicinity of the second and third electrodes G2 and G3, and then are diverged from the cross over points. The diverged electron beams are pre-converged by a pre-focusing lens formed of the second and third electrodes G2 and G3, and further pre-converged by a sub-lens formed of the third and fourth electrodes G3 and G4 and the segment electrode G51 of the fifth electrode G5. After that, the electron beams are finally converged onto the phosphor screen by a main lens formed of the segment electrode G52 of the fifth electrode G5 and the sixth electrode G6.

If in this case, the electron beams are directed to a central portion of the screen without being deflected, the electrodes G51 and G52 are maintained at the same potential, and no electronic lens is formed between the electrodes G51 and G52. If, on the other hand, the electron beams are deflected and directed to portions of the screen other than the central portion, a four-pole lens is formed between the segment electrodes G51 and G52, in which the electron beams converge in a horizontal direction, i.e. in a horizontal plane, and are diverged in a vertical direction, i.e. in a vertical plane. Accordingly, the distortion of a beam spot (the spot has a horizontally long core portion of a high luminance and a vertically extending halo portion of a low luminance), which may occur at a peripheral portion of the screen due to a non-uniform magnetic field generated by a deflecting yoke, is corrected, thereby enhancing the resolution of the entire screen.

Figure 4A:
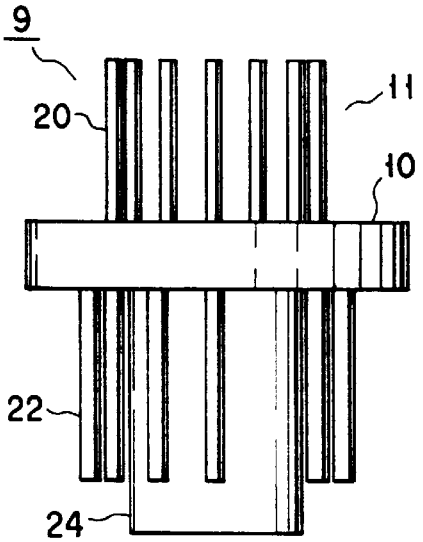
FIG. 4A is a schematic front view illustrating the structure of the stem of the electron gun assembly of FIG. 3.
Figure 4B:
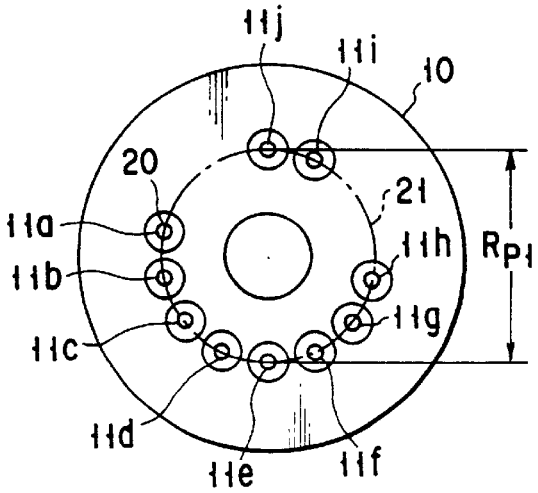
FIG. 4B is a schematic top view showing the structure of the stem shown in FIG. 4A.
Figure 4C:
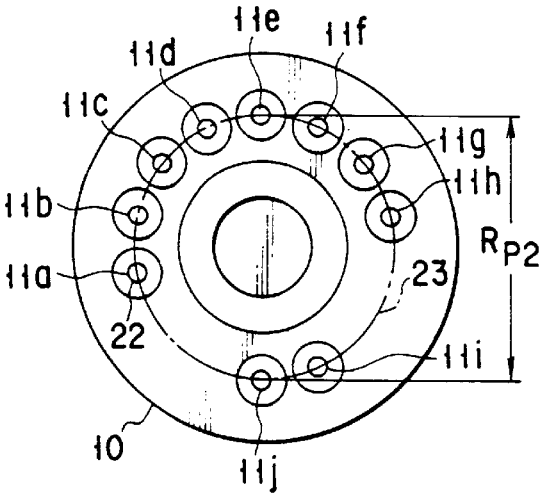
FIG. 4C is a schematic bottom view showing the structure of the stem shown in FIG. 4A.

In such a color cathode ray tube, in particular, in the color cathode ray tube of this embodiment, the outer diameter of the neck 2, in which the electron gun assembly 8 is provided, is set at 22.5 mm. Further, the stem 9 that seals the end of the neck 2, shown in FIG. 4A, has a structure as shown in FIGS. 4A and 4B, in which ten stem pins 11 are provided circumferentially on portions of the flare section 10 such that they extend through the flare section 10 in an airtight manner. More specifically, in the neck 2, the stem pins 11 each include an inner lead 20 corresponding to a portion located in the neck tube, and an outer pin 22 corresponding to a portion located outside the tube. The inner leads 20 are located along an inner pin circle 21, while the outer pins 22 are located along an outer pin circle 23. The diameter RP1 of the inner pin circle 21 is set at 14.0 mm, and the diameter PR2 of the outer pin circle 23 is set at 15.24 mm, which is identical to the diameter of the pin circle of a stem designed for a neck with a nominal size of 29.1 mm.

Figure 5:
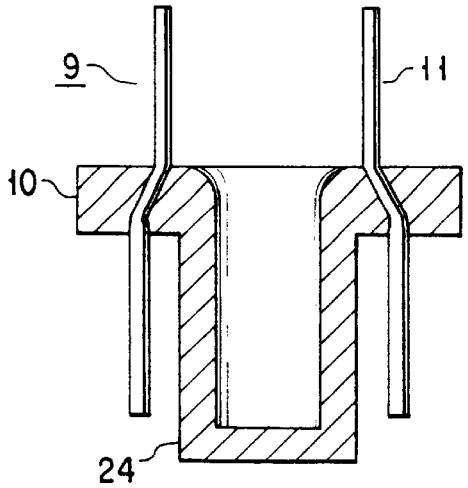
FIG. 5 is a schematic sectional view showing the structure of the stem shown in FIG. 4A.

The stem 9 of the above structure is formed by bending each stem pin 11, preferably, by burying the bent portion in the flare section 10 as shown in FIG. 5.

Eight 11*a*–11*h* of the ten stem pins to be connected to the heaters, the cathodes and the electrodes other than the two segment electrodes of the fifth electrode, to which a relatively low voltage is applied, are located adjacent to each other at regular intervals. Two stem pins 11*i* and 11*j* to be connected to the two segment electrodes of the fifth electrode, to which a relatively high voltage is applied, are located adjacent to each other at the same interval as the stem pins 11*a*–11*h*. The interval between each of the stem pins 11*i* and 11*j* and a corresponding one of the stem pins 11*a*–11*h* is set at a value that is about three times the interval between each pair of adjacent ones of the stem pins 11*a*–11*h*.

Figure 6A:
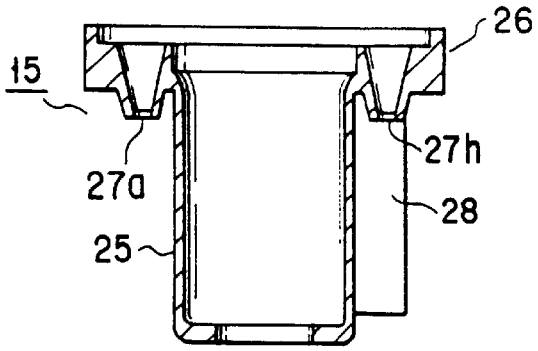
FIG. 6A is a cross sectional view showing a base to which the base shown in FIG. 4A is adhered.
Figure 6B:
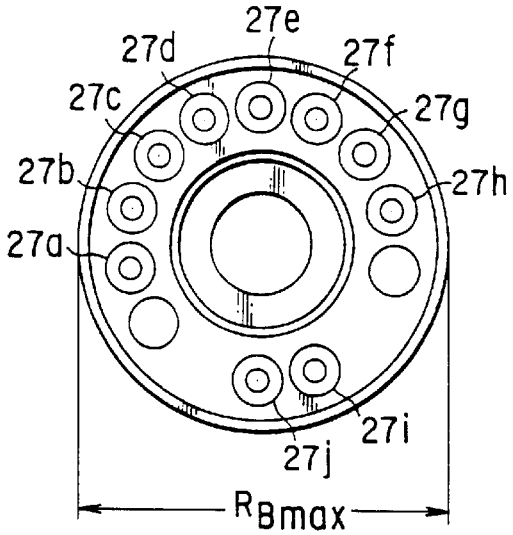
FIG. 6B is a top view showing the base to which the stem shown in FIG. 4A is adhered.
Figure 6C:
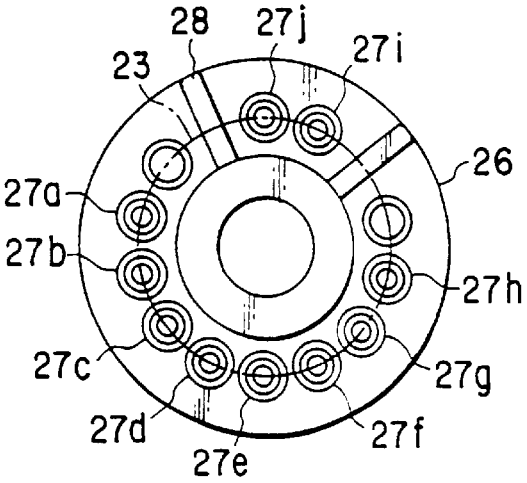
FIG. 6C is a bottom view showing the base to which the stem shown in FIG. 4A is adhered.

The base 15 to be connected to the stem 9 has a structure as shown in FIGS. 6A, 6B and 6C. The base 15 has a cylindrical section 25 for receiving therein an exhaust pipe 24 (shown in FIG. 4A) sealed by the stem, and an annular brim or flange section 26 formed at the opening edge of the cylindrical section 25 and to be attached to the flare section. The brim section 26 has ten stem-pin inserting holes 27*a*–27*j* formed therein for fitting the ten stems pins therethrough such that they can slide.

In particular, in this embodiment, the diameter RB of the brim section 26 of the base 15 is set at 22.2 mm smaller than the outer diameter (22.5 mm) of the neck, as shown in FIG. 6A. Two partitions 28 radially extend on the surface of the brim section 26 at the cylinder section 25 side, i.e. on the surface of the brim section 26 opposite to the surface to be adhered to the flare section of the stem, as is shown in FIG.

6C. These two partitions 28 partition the group of the stem pins connected to the two segment electrodes of the fifth electrode to which a relatively high voltage is applied, from the group of the stem pins connected to the heaters, the cathodes and the electrodes other than the segment electrodes of the fifth electrode, to which a relatively low voltage is applied. As a result, creeping leakage of voltage is suppressed, which may occur on the base 15 due to a potential difference between the stem pins connected to the two segment electrodes of the fifth electrode to which a relatively high voltage is applied, from the stem pins connected to the heaters, the cathodes and the electrodes other than the segment electrodes of the fifth electrode, to which a relatively low voltage is applied.

As shown in FIG. 6C, the partitions 28 each radially extend across the pin circle 23 for the outer pins of the stem pins, toward the inner edge. Accordingly, each of the partitions 28 are located between a corresponding one of the two stem-pin inserting holes 27*i* and 27*j* through which the stem pins connected to the two segment electrodes of the fifth electrode are inserted, and the group of the eight stem-pin inserting holes 27*a*–27*h* through which the stem pins connected to the heaters, the cathodes and the electrodes other than the two segment electrodes of the fifth electrode. The partitions 28 extend to the outer edge of the top surface of the brim section 26. As is shown in FIG. 6A, the partitions 28 extend on the outer surface of the cylindrical section 25 such that they are longer than the stem pins which pass through the stem-pin inserting holes 27*a*–27*j* and extend to the outside of the base 15.

The partitions 28 of the base 15 shown in FIG. 6A terminate at the outer edge of the top surface of the brim section 26, and there is provided no circumferential partition section that partitions, together with the partitions 28, the group of stem pins fitted through the stem-pin inserting holes 27*i* and 27*j* for applying a relatively high voltage, from the group of stem pins fitted through the stem-pin inserting holes 27*a*–27*h* for applying a relatively low voltage.

In the above-described structure, a necessary number of stem pins 11 for a color cathode ray tube equipped with the electron gun assembly shown in FIG. 3 can be provided for the stem 9 to enhance the resolution of the color cathode ray tube. Further, the maximum diameter RB max (the diameter of the brim section 26) of the base 15, which is adhered to the stem to protect it, can be set at 22.2 mm. This means that the diameter of the base can be set smaller than the outer diameter of the neck 2, i.e. 22.5 mm. Accordingly, the coil diameter of a deflecting yoke 16 to be mounted on the funnel 3 from the neck 2 side can be reduced so as to make the yoke tightly contact the outer surface of the neck 2, with the result that the power consumption of the deflecting yoke can be reduced, which leads to a reduction of power required for a color cathode ray tube of a high resolution.

Figure 1A:
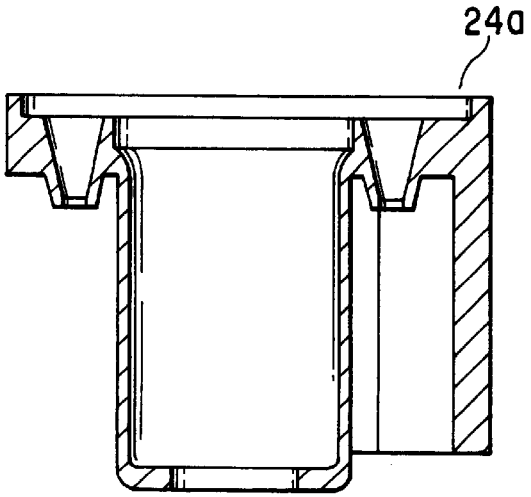
FIG. 1A PRIOR ART
FIG. 1A is a schematic cross sectional view illustrating the structure of a base used in an electron gun assembly that is incorporated in a conventional high-resolution color cathode ray tube.
Figure 1B:
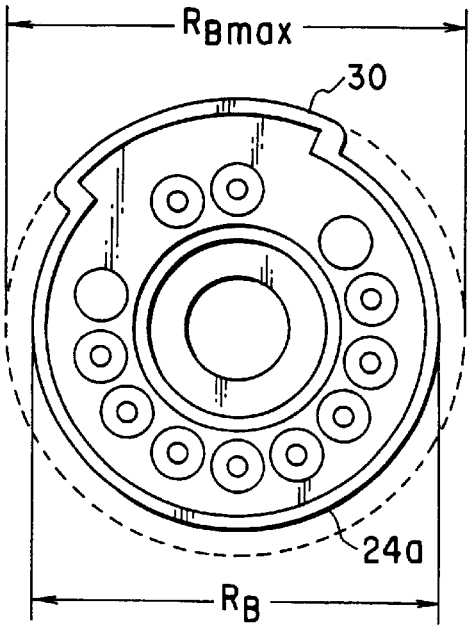
FIG. 1B PRIOR ART
FIG. 1B is a schematic top view illustrating the structure of the base shown in FIG. 1A.
Figure 1C:
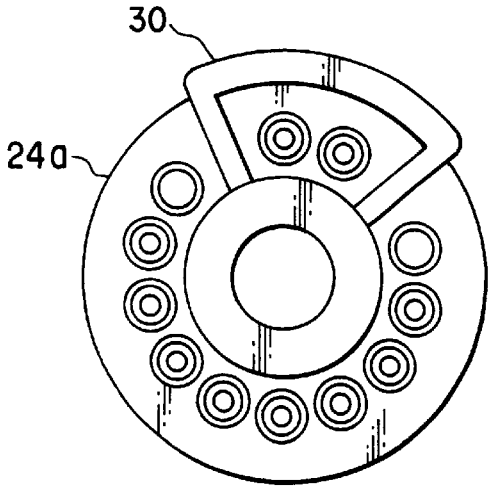
FIG. 1C PRIOR ART
FIG. 1C is a schematic bottom view illustrating the structure of the base shown in FIG. 1A.

In the conventional high-resolution color cathode ray tube shown in FIG. 1, part of a brim section 24*a* of the base circumferentially extends, and the outer diameter RB of a small-diameter portion of the base can be set at 23.6 mm. In this case, however, the radius of a projection 30 is 12.5 mm, which means that the maximum diameter LB max of a circle including the projection and to be formed around the tube axis is 25.0 mm, and even the maximum width of the base end surface is 24.3 mm (=12.5 mm+11.8 mm). Therefore, even if the outer diameter of the neck is set at 22.5 mm, the coil of the deflecting yoke cannot be reduced to a size with which it can be tightly fitted on the outer surface of the neck, and accordingly the power cannot be sufficiently saved. On the other hand, in the structure of the embodiment, the deflecting yoke can be fitted on the neck 2, thereby enabling the power saving of the high-resolution color cathode ray tube that requires lots of stem pins 11.

Moreover, even if in the above-described structure of the invention, the interval between each pair of adjacent stem pins 11 is narrowed, a sufficiently high withstand voltage can be obtained by virtue of the structure wherein each interval between the outer pins 21, which should be particularly considered in light of withstand voltage, is widened, and the partitions 28 are provided on the base end surface across the pin circle of the stem pins 11 for partitioning, in order to suppress the creeping leakage of voltage on the base 15, the group of the stem pins 11*i* and 11*j* connected to the two segment electrodes G51 and G52 of the fifth electrode G5 to which a relatively high voltage is applied, from the group of the stem pins 11*a*–11*h* connected to the heaters HB, HG and HR, the cathodes KB, KG and KR and the electrodes other than the segment electrodes G51 and G52 of the fifth electrode G5, to which a relatively low voltage is applied.

In addition, in the conventional assemblage of a stem and a socket incorporated in a display unit such as an image receptor, the axes of the stem and the socket are aligned in the cylindrical section of the base, which covers an exhaust pipe contained therein, by positioning the radially extending partitions in a direction of rotation. The cylindrical section 25 and the partitions 28 of the base 15 can be connected to a socket that is designed to be connected to a base for the stem of a conventional 29.1 mm neck. Thus, the base of the invention is also compatible with the conventional socket, which means that no particular socket is necessary.

A base having a different structure from the above embodiment will be explained.

Figure 7A:
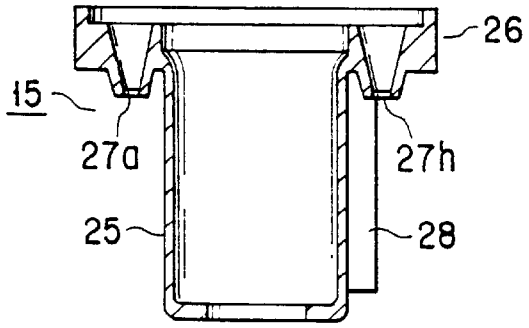
FIG. 7A is a schematic front view illustrating a base that has a structure different from the stem shown in FIGS. 6A–6C.
Figure 7B:
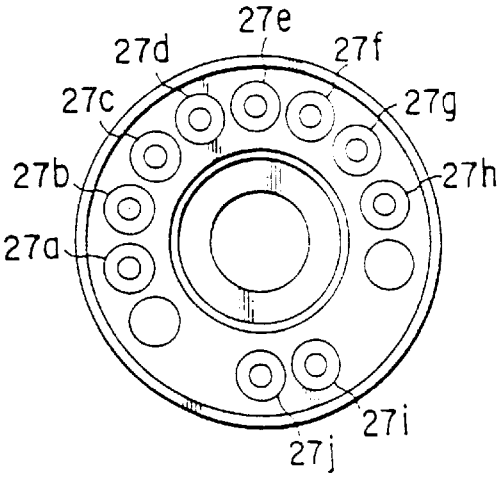
FIG. 7B is a schematic top view showing the base of FIG. 7A.
Figure 7C:
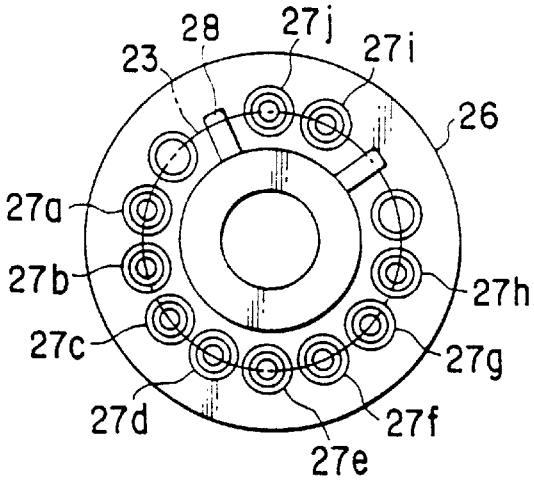
FIG. 7C is a schematic bottom view showing the base of FIG. 7A.

In a base 15 shown in FIGS. 7A–7C, the two partitions 28 do not extend to the outer edge of the top surface of the brim section 26, which partition the group of the stem pins connected to the two segment electrodes of the fifth electrode to which a relatively high voltage is applied, from the group of the stem pins connected to the heaters, the cathodes and the electrodes other than the segment electrodes of the fifth electrode, to which a relatively low voltage is applied. The partitions cross the pin circle 23 of the stem outer pins and extend to an intermediate portion between the pin circle 23 and the outer edge of the top surface of the brim section 26. The other structural elements of this base are similar to those of the base shown in FIGS. 6A–6C, and are therefore not described in detail but just denoted by similar reference numerals to those used in FIGS. 6A–6C.

This structure can also provide a color cathode ray tube that has a similar advantage to the aforementioned embodiment.

Figure 8A:
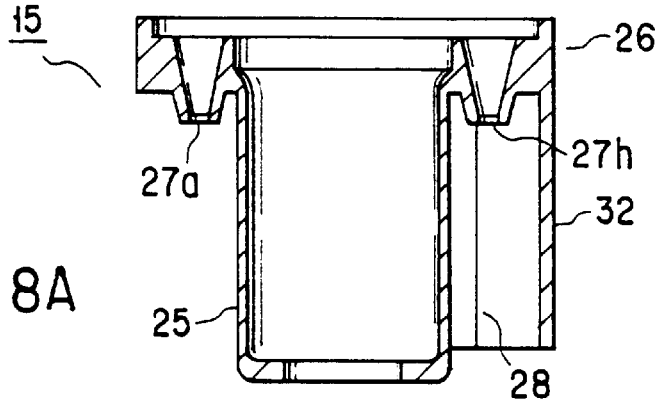
FIG. 8A is a schematic front view showing a base that has a structure different from the base shown in FIGS. 7A–7C.
Figure 8B:
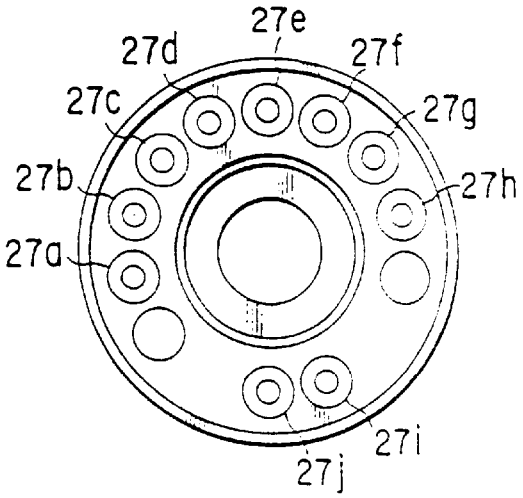
FIG. 8B is a schematic top view showing the base of FIG. 7A.
Figure 8C:
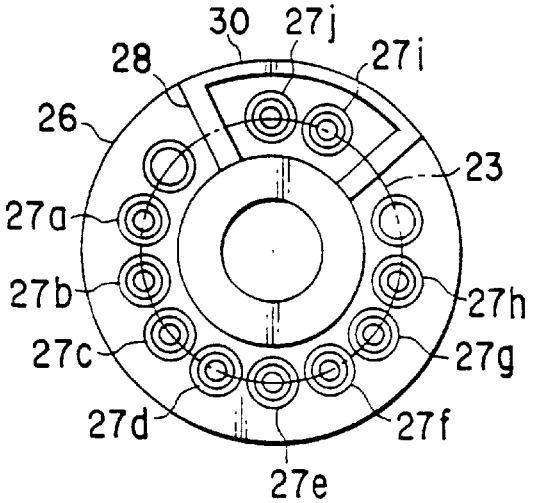
FIG. 8C is a schematic bottom view showing the base of FIG. 7A.

In a base 15 shown in FIGS. 8A–8C, a circumferential partition section 30 is provided outside the stem-pin inserting holes 27*i* and 27*j* through which the stem pins connected to the two segment electrodes of the fifth electrode to which a relatively high voltage is applied extend, i.e. along the outer edge of the top surface of the brim section 26 as shown in those figures. The circumferential partition section partitions, together with radially extending partition sections 28, the group of the stem pins connected to the two segment electrodes of the fifth electrode to which a relatively high voltage is applied, from the group of the stem pins connected to the heaters, the cathodes and the electrodes other than the segment electrodes of the fifth electrode, to which a relatively low voltage is applied. The other structural elements of this base are similar to those of the base shown in FIGS. 6A–6C, and are therefore not described in detail but just denoted by similar reference numerals to those used in FIGS. 6A–6C.

Since in this structure, the circumferential partition section 30 does not directly influence the connection of the base to the socket of a display unit, the base can be connected to a socket that is designed to be connected to a base for the stem of a conventional 29.1 mm neck. Thus, this base is also compatible with the conventional socket, and enables the provision of a color cathode ray tube having the same advantage as described above.

Figure 9:
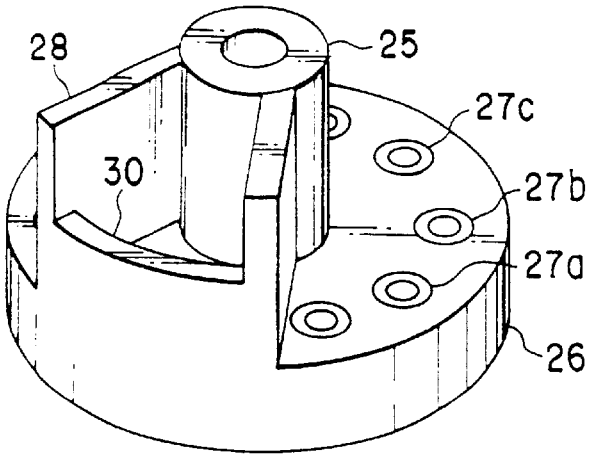
FIG. 9 is a schematic perspective view illustrating a base that has a structure different from the base shown in FIGS. 8A–8C.

In a base 15 shown in FIG. 9, there is provided a circumferential partition section 30 similar to that shown in FIGS. 8A–8C but having a height lower than the partition sections 28. The other structural elements of this base are similar to those of the base shown in FIGS. 6A–6C, and are therefore not described in detail but just denoted by similar reference numerals to those used in FIGS. 6A–6C.

Since in this structure, the circumferential partition section 30 does not directly influence the connection of the base to the socket of a display unit, the base can be connected to a socket that is designed to be connected to a base for the stem of a conventional 29.1 mm neck. Thus, this base is also compatible with the conventional socket, and enables the provision of a color cathode ray tube having the same advantage as described above.

Although the above-described embodiments employ a neck outer diameter of 22.5 mm, the invention is applicable to all color cathode ray tubes whose nominal neck outer diameter is 22–23 mm.

Further, although the embodiments employ a case where the pin circle of the stem pin inner leads located in the tube has a diameter of 14 mm, the invention is applicable to any case where the pin circle of the inner leads has a diameter of 15.24 mm or less.

Moreover, although the embodiments employ color cathode ray tubes equipped with an electron gun assembly having first to sixth electrodes, the invention is also applicable to a color cathode ray tube equipped with an electron gun assembly of a different structure.

If, as described above, the neck outer diameter is set at 22–23 mm, the nominal diameter of the pin circle of the stem pins outside the flare section is set at 15.24 mm, and the maximum diameter of the base is set at 23 mm or less, the coil diameter of the deflecting yoke to be mounted on the outer surface of the funnel can be reduced to a size with which the deflecting yoke can tightly contact the outer surface of the neck, thereby reducing the power consumption of the deflecting yoke and hence of the color cathode ray tube, and further enhancing the resolution of the color cathode ray tube with its power consumption reduced.

What is claimed is:

1. A color cathode ray tube comprising:

a vacuum envelope including a substantially cylindrical neck, a funnel having an extended portion extending from the neck, and a panel coupled to the funnel;

an electron gun assembly located in the neck and having cathodes, heaters for heating the cathodes and a plurality of electrodes for focusing electron beams emitted from the cathodes;

a stem including a plurality of stem pins connected to the cathodes, the heaters and predetermined ones of the electrodes, and a flare section welded to an end of the neck, the stem pins being airtightly inserted circumferentially through predetermined portions of an outer surface of the flare section of the stem such that the predetermined portions form a reference circle; and a base adhered to the flare section of the stem and having stem-pin inserting holes through which the stem pins are inserted, wherein the neck has an outer diameter of from 22 mm to 23 mm, the reference circle formed by the stem pins on the outer surface of the flare section is set at a pin circle with a nominal diameter of 15.24 mm, and the base has a diameter not more than a maximum diameter of 23 mm.

2. A color cathode ray tube according to claim 1, wherein the electron gun assembly is of a dynamic type in which a voltage that varies in synchronism with a deflection of electron beams emitted from a deflecting yoke is applied to at least one electrode selected from the plurality of electrodes, the voltage that varies in synchronism with the deflection of the electron beams being applied via at least one of the stem pins.

3. A color cathode ray tube according to claim 1, wherein a number of the stem pins is not less than 9.

4. A color cathode ray tube according to claim 1, further comprising radial partitions that radially extend on a surface of the base opposite to a surface thereof adhered to the stem, and partition stem pins connected to electrodes to which a relatively high voltage is applied from stem pins connected to electrodes, to which a relatively low voltage is applied.

5. A color cathode ray tube according to claim 4, wherein the radial partitions extend across the pin circle of the stem pins to an outer edge of the base.

6. A color cathode ray tube according to claim 4, wherein the radial partitions extend across the pin circle of the stem pins to an outer edge of the base, and include a circumferential partition that partitions, together with the radial partitions, the stem pins connected to the electrodes to which the relatively high voltage is applied from the stem pins connected to the electrodes, to which the relatively low voltage is applied.

7. A color cathode ray tube according to claim 6, wherein the circumferential partition has a height lower than a height of the radial partitions that extend across the pin circle of the stem pins to the outer edge of the base.

8. A color cathode ray tube according to claim 6, wherein the circumferential partition extends along the outer edge of the base.

9. A color cathode ray tube according to claim 4, wherein the radial partitions extend across the pin circle of the stem pins to an intermediate portion between the pin circle and the outer edge of the base.

10. A color cathode ray tube according to claim 4, wherein the radial partitions have a height greater than a length of the stem pins that extend to an outside of the base.

* * * * *